US010328724B2

(12) United States Patent
Zuza Irurueta et al.

(10) Patent No.: US 10,328,724 B2
(45) Date of Patent: Jun. 25, 2019

(54) PRINTING SYSTEM WITH A PRINTING FLUID COLLECTOR

(71) Applicant: HEWLETT-PACKARD DEVELOPMENT COMPANY, L.P., Houston, TX (US)

(72) Inventors: Mikel Zuza Irurueta, Barcelona (ES); Albert Crespi Serrano, Sant Cugat del Valles (ES); Oriol Borrell Avila, Sabadell (ES); Frederic Barnel, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/544,422

(22) PCT Filed: Mar. 25, 2015

(86) PCT No.: PCT/EP2015/056478
§ 371 (c)(1),
(2) Date: Jul. 18, 2017

(87) PCT Pub. No.: WO2016/150507
PCT Pub. Date: Sep. 29, 2016

(65) Prior Publication Data

US 2018/0009238 A1 Jan. 11, 2018

(51) Int. Cl.
*B41J 2/17* (2006.01)
*B41J 11/00* (2006.01)
*B41J 3/407* (2006.01)

(52) U.S. Cl.
CPC ..... *B41J 11/009* (2013.01); *B41J 2/1721* (2013.01); *B41J 3/4078* (2013.01);
(Continued)

(58) Field of Classification Search
CPC ... B41J 11/009; B41J 11/0085; B41J 11/0095; B41J 2002/1742
See application file for complete search history.

(56) References Cited

U.S. PATENT DOCUMENTS 6,254,081 B1 * 7/2001 Rasmussen ..... B41J 11/009 271/108
6,361,230 B1 3/2002 Crystal
(Continued)

FOREIGN PATENT DOCUMENTS

DE 19929282 12/2000
EP 0740193 10/1996
(Continued)

OTHER PUBLICATIONS

Wang, An-ling et al., "Permeating of Printing Ink in Porous Papers in Printing Process of Roller Printer", Packaging Engineering, vol. 27, No. 2, 2006, 3 pages.

*Primary Examiner* — Julian D Huffman
(74) *Attorney, Agent, or Firm* — HP Inc. Patent Department

(57) ABSTRACT

Certain examples described herein relate to printing systems and methods of operating the same. In an example of a printing system, a porosity determiner determines a porosity of a print medium and a signal generator generates a signal relating to a state of a printing fluid collector based on the porosity determined. In an example of a method of operating a printing system, a pressure measurement is obtained from a vacuum system of the printing system when a print medium is present on a media path of the printing system. This is compared to at least one predefined pressure range and, based on the comparison, an indication is provided setting out a state of a printing fluid collector.

20 Claims, 5 Drawing Sheets

(52) U.S. Cl.
CPC ..... *B41J 11/0085* (2013.01); *B41J 11/0095* (2013.01); *B41J 2002/1742* (2013.01)

(56) References Cited

U.S. PATENT DOCUMENTS

| | | | | |
|---|---|---|---|---|
| 2006/0150840 | A1 | 7/2006 | Lee et al. | |
| 2013/0293603 | A1 | 11/2013 | Roof et al. | |
| 2014/0354716 | A1* | 12/2014 | Saito | B41J 11/0005 347/6 |
| 2015/0343805 | A1* | 12/2015 | Young | B41J 11/0085 347/16 |

FOREIGN PATENT DOCUMENTS

| | | |
|---|---|---|
| EP | 1457347 | 9/2004 |
| JP | 2006248024 | 9/2006 |
| JP | 2006248152 | 9/2006 |
| JP | 2009298013 | 12/2009 |
| WO | WO-2012050577 | 4/2012 |

* cited by examiner

PRINTING SYSTEM WITH A PRINTING FLUID COLLECTOR

BACKGROUND

Printing systems may be arranged to transport a print medium along a media path and allow for a printing fluid to be deposited onto the print medium. A media transport system may be used to transport the print medium along the media path, it may comprise a set of driven rollers or a belt. Printing fluid may be deposited onto the print medium using fluid ejection technologies. A variety of materials may be used as print media in such printing systems, for example papers, cards, plastics and textiles.

BRIEF DESCRIPTION OF THE DRAWINGS

Various features of the present disclosure will be apparent from the detailed description which follows, taken in conjunction with the accompanying drawings, which together illustrate, by way of example only, features of the present disclosure, and wherein.

DETAILED DESCRIPTION

Figure 1:
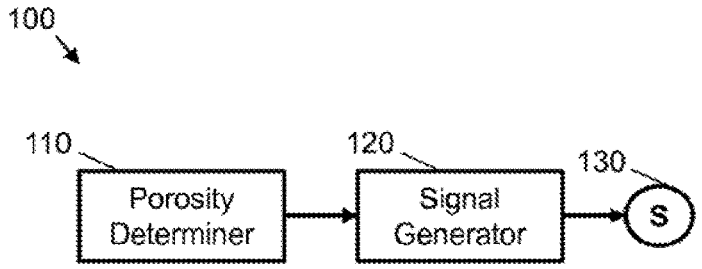
FIG. 1 is a schematic illustration of a printing system according to an example.

During a printing operation, printing fluid deposited onto a print medium may penetrate the print medium to a degree dependent on the print medium's porosity. When a print medium having a sufficiently high porosity is used, printing fluid may permeate the print medium completely, leading to a leakage of printing fluid. This leakage may negatively affect the printing process. In one case, the media path may become stained. For example, a platen above a vacuum generator for the media path may become stained with ejected ink. This may result in the staining of an underside of print media in subsequent printing operations. Another issue is that a printer vacuum system, which may involve the flow of air through holes on a component of the media path in order to retain the print medium on the media path during the printing operation, may malfunction due to the blockage of such holes with printing fluid. These holes may comprise holes in a platen or belt. Excess printing fluid may also clog mechanical components of the printing system and affect electronic circuits within the printing system. These and other leakage-related faults may involve cleaning, servicing or replacement of components to be carried out, resulting in expense and printing system downtime. Examples of particularly porous materials commonly used as print media, which may affect the printing process as described, include textiles and fabrics. The term "porous material" and variants thereof are henceforth used to mean materials having a sufficiently high porosity that printing fluid may typically be able to traverse a medium which comprises the material. A "printer" or "printing system" as described herein may comprise any device suitable for performing an additive manufacturing process, which may include but not be limited to systems for additive manufacturing in two-dimensions and/or three-dimensions.

In order to reduce the effect of printing fluid staining or impeding the media path after permeating a porous medium, a printing fluid collector may be installed in relation to the media path. The printing fluid collector may be arranged to collect excess printing fluid that permeates the print medium. For example, a printing fluid collector may be arranged, in use, to be underneath the print medium, e.g. located below the media path. In certain cases a printing fluid collector may replace a platen of the media path that is installed above a vacuum generator for the media path.

Certain examples described herein allow for a determination of a porosity of a print target in a printing system. A signal relating to a state of a printing fluid collector is then generated according to the determined porosity. For example, this signal may prevent a print operation if a suitable printing fluid collector is not installed to reduce the issues of printing fluid permeation described above. The printing fluid collector may be removably installed in the printing system via a collector coupling, which may be arranged to mount the printing fluid collector to receive printing fluid. In certain cases, a presence of a printing fluid collector may be determined with one or more sensors associated with the collector coupling. Certain examples determine the porosity based on a pressure measurement obtained from a vacuum system located on a media path of the printing system when the print target is present on the media path. The pressure measurement may be compared to at least one predefined pressure range in order to indicate a state of the printing fluid collector. In certain examples, a predefined pressure range may correspond to an obtained width of the print target. Certain examples allow for the obtaining of a signal indicative of whether the printing fluid collector is installed in the printing system. In one case, at least one switch may be arranged in relation to a printing fluid collector coupling such that, if the printing fluid collector is installed in the printing system, the at least one switch causes the generation of said signal. If it is determined that the printing fluid collector is not installed, a signal may be generated to inhibit a printing operation.

Certain examples described herein increase printing system robustness when handling a variety of print media. This may be achieved by preventing a printing operation when it is determined that a porous medium is present on the media path and a suitable printing fluid collector is not installed. By preventing excess printing fluid ejection from leaking onto or into the media path, vacuum system or other printer components, e.g. following permeation or penetration of a porous print medium, printing system downtime may be reduced and there may a reduced need for servicing, replacement and cleaning.

FIG. 1 shows a printing system 100 according to an example. The printing system 100 comprises a porosity determiner 110 connectively coupled to a signal generator 120. The porosity determiner 110 is configured to determine a porosity of a print medium in the printing system 100. The signal generator is configured to generate a signal 130 relating to a state of a printing fluid collector based on the determined porosity, e.g. the output of the porosity determiner 110 as supplied to the signal generator 120. In one case, the signal generator 120 may be configured to obtain a signal indicative of a state of a printing fluid collector and, if it is determined from said signal that the printing fluid collector is not present and the print medium is deemed porous, generate a signal 130 indicating that the printing fluid collector be installed. This may involve interrupting a print operation until the signal indicative of a state of a printing fluid collector indicates that the printing fluid collector is present.

The porosity determiner 110 may, according to one example, comprise a pressure sensor arranged to measure a pressure in a vacuum system of the printing system. In another example, the porosity determiner 110 comprises control electronics arranged to compare an obtained pressure measurement with at least one predefined pressure range. In a further example, the porosity determiner 110 comprises a pressure sensor arranged to measure a pressure a vacuum system of the printing system and control electronics arranged to compare an obtained pressure measurement with at least one predefined pressure range and determine a porosity of the print medium based on the comparison.

In one example, the porosity of the print medium may be a measure of the degree to which a fluid may permeate the print medium during a given time period. In another example, the porosity of the print medium may be a measure of the time taken for a fluid to pass through a given width of medium. In a further example, the porosity of the print medium may be a measure of a change in pressure of a fluid, for example air, passing through the medium. The porosity of the print medium may, according to a still further example, be a measure of a void fraction of the material used as the print medium. The signal 130 may, according to one example, be used to notify a user regarding the state of the printing fluid collector via an interface of the printing system. The notification may comprise text output, audio output, graphical output or any combination thereof. The notification may inform the user that a suitable printing fluid collector needs to be installed in the printing system, e.g. if it is further detected that the printing fluid collector is not installed. In another example, the signal 130 may be used to determine whether a suitable printing fluid collector is presently installed in the printing system. In a further example, the signal 130 may be used to prevent a printing operation upon the print medium.

The printing fluid collector described herein may also be known, for example, as a gutter, a drip tray, an ink collector or a waste ink collection tray. The terms "print medium", "medium", "print target", "printing substrate" and "substrate" are used herein interchangeably. The term "printing fluid" as used herein refers to any fluid suitable for printing, including, amongst others an ink, a gloss, a varnish and a coating. In certain cases multiple printing fluid collectors may be available for installation. In such cases a particular printing fluid collector may be associated with a particular range of determined pressures and/or porosities. For example, highly porous printing substrates may require a printing fluid collector with a first filter configuration and/or a first fluid capacity and semi-porous printing substrates may require a printing fluid collector with a second filter configuration and/or a second fluid capacity, e.g. where the first fluid capacity is greater than the second fluid capacity.

Figure 2:
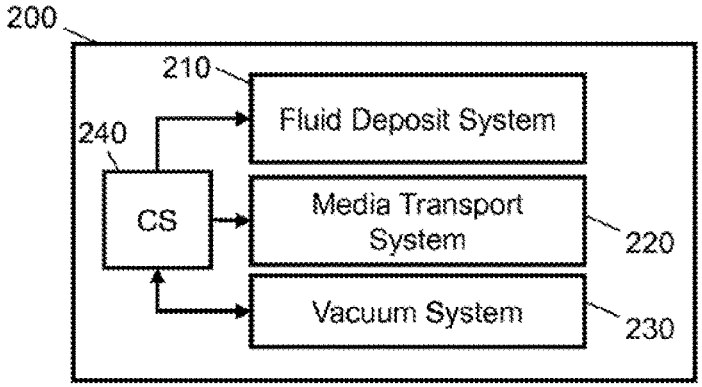
FIG. 2 is a schematic illustration showing a printing system according to an example.

FIG. 2 shows certain components of a printing system 200 according to an example. The components shown are those that may interact with the porosity determiner 110 and the signal generator 120 of FIG. 1. The printing system may comprise further components, however these are omitted in the present description for ease of explanation. In the example of FIG. 2, four components of the printing system 200 are shown: a fluid deposit system 210, a media transport system 220, a vacuum system 230 and a control system 240.

The fluid deposit system 210 is used to deposit printing fluid onto a print medium in the printing system 200. The fluid deposit system 210 may comprise an inkjet deposit system. The print medium is transported along a media path by the media transport system 220. The media transport system 220 may comprise an arrangement of one or more belts and/or one or more rollers to transport the print medium. These belts and/or rollers may be driven by a drive mechanism, e.g. one or more electromechanical motors. In the printing system 200 of FIG. 2, the print medium is retained on the media path during a printing operation by the use of a vacuum system 230. The vacuum system 230 is arranged to generate a vacuum in relation to the media path, e.g. below one or more belts and/or one or more rollers of the media transport system 220. If the media transport system 220 comprises one or more belts or platens then a force may be applied to a print medium on the media path, e.g. downwards onto the one or more belts and/or platens, by way of an air flow through apertures in said one or more belts and/or platens, the air flow resulting from the vacuum generated by the vacuum system 230. The control system 240 is connectively coupled to the fluid deposit system 210, media transport system 220 and vacuum system 230. In FIG. 2, the control system 240 controls the operation of the fluid deposit system 210, the media transport system 220 and the vacuum system 230. Although in this example one control system 240 is used to control the three components, in other examples, a set of separate control components, e.g. controller electronics, may be used to individually control the three components. In general, any arrangement that enables the control functionality described herein may be used. FIG. 2 is provided to help explain an example context for operation of the apparatus of FIG. 1 and the method of FIG. 5 and should not be seen as limiting.

In one case, one or both of the porosity determiner 110 and signal generator 120 of FIG. 1 may be implemented as part of the control system 240. In other cases, one or both the porosity determiner 110 and signal generator 120 of FIG. 1 may be implemented as part of the vacuum system 230. In one example, the control system 240 may be configured to receive a pressure measurement from the vacuum system 230, to determine a porosity based on the received pressure measurement, and to generate a signal relating to a state of a printing fluid collector based on the determined porosity. In another example, the control system 240 may be configured to receive a signal from the vacuum system 230 relating to a state of a printing fluid collector, and to generate a notification to a user via an interface of the printing system. In a further example, the control system 240 may be configured to prevent a printing operation, based on receiving a signal indicating that a suitable printing fluid collector is not installed in the printing device, by sending signals to one or both of the fluid deposit system 210 and the media transport system 220.

Figure 3A:
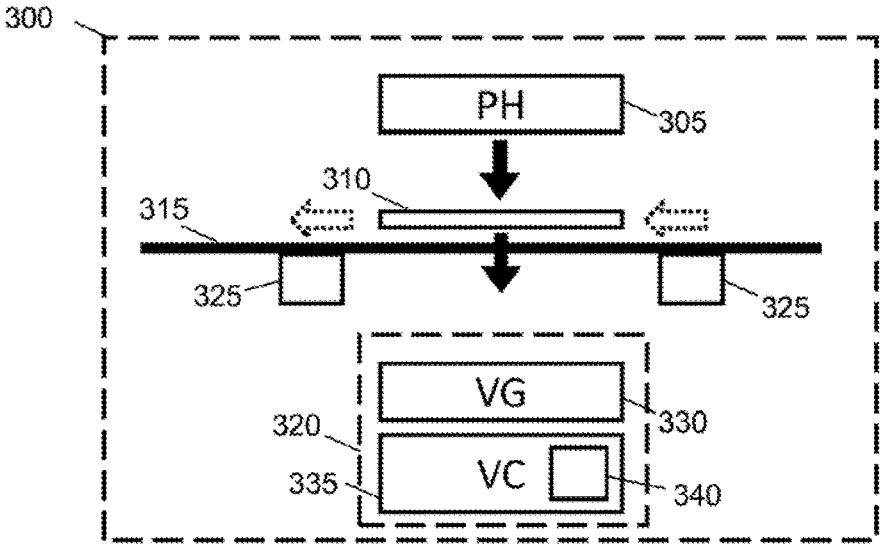
FIG. 3A is a schematic illustration showing a printing system according to an example.
Figure 3B:
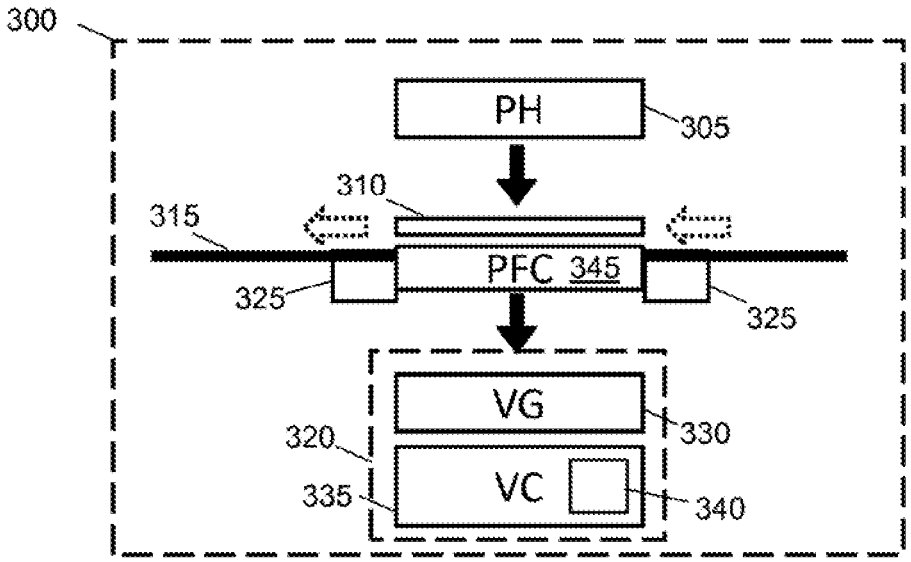
FIG. 3B is a schematic illustration showing the printing system of FIG. 3A with an installed printing fluid collector.

FIGS. 3A and 3B show a printing system 300 in more detail according to an example. A print head 305 deposits printing fluid onto a print medium 310. The print medium 310 is transported (as shown by the white arrows) along a media path 315. In FIGS. 3A and 3B the print medium 310 is transported horizontally from the right hand side of the Figure to the left hand side of the Figure, although actual implementations may vary from the schematic example illustrations. A vacuum system 320 is arranged to provide a fluid flow (as shown by the black arrows) through the media path 315, so as to apply a force to the print medium 310 to retain the print medium 310 on the media path 315 during a print operation. In one case, one or more belts and/or platens may be located above the vacuum system 320 to support the print medium 320 as part of the media path 315. In FIGS. 3A and 3B the fluid flow is shown operating vertically, e.g. from the top of the Figure to the bottom of the Figure, although again actual implementations may vary from the schematic example illustrations. In one case, the fluid flow may comprise an air flow. The vacuum system 320 comprises at least one vacuum generator 330 arranged below the media path 315 and a vacuum chamber 335 arranged in fluid communication with the at least one vacuum generator 330. At least one pressure sensor 340 is arranged in the vacuum chamber 335 to provide a pressure measurement. A collector coupling 325 is arranged to removably couple a printing fluid collector 345 to the printing system 300. FIG. 3A shows the printing system 300 without the printing fluid collector 345 coupled to it, and FIG. 3B shows the printing system 300 with the printing fluid collector 345 coupled to it. The collector coupling 325 is arranged to mount the printing fluid collector 345 to receive printing fluid during a print operation. In FIG. 3A the collector coupling 325 is arranged above the vacuum system 320 below the print head 305. In other examples, the collector coupling 325 may be arranged within the vacuum system 320. In one case, one or more mechanical components, e.g. platens, roller or belts, may be installed in place of a printing fluid collector. In certain examples, these may be coupled to the collector coupling 325; in other examples they may have separate mechanical couplings.

The print head 305 may comprise a plurality of nozzles for depositing printing fluid onto the print medium. The configuration of the print head may vary based on the type of printing system and the type of printing fluid used. The media path 315 may comprise a platen. In one case, at least a portion of the media path below the print head 305 may comprise a platen having a plurality of holes to allow the fluid flow provided by the vacuum system through the media path. In certain examples, the platen may be driven, e.g. convey the print medium along the media path; in other examples the platen may be static, e.g. driven components of the media transport system may be located on at least one side of the platen. The at least one vacuum generator 330 may comprise one or more of: at least one vacuum pump, at least one vacuum ejector, at least one vacuum fan; and at least one vacuum blower. The at least one vacuum generator 330 may be driven at a constant power during a printing operation. In another case, the at least one vacuum generator may be driven at a varying power during a printing operation. The vacuum chamber 335 may, according to various examples, be a chamber within which the pressure is lower than the atmospheric pressure. The pressure within the vacuum chamber may be lowered by the driving of the at least one vacuum generator 330.

The collector coupling 325 may, according to one example, be a mechanical coupling arranged to receive a printing fluid collector 345 as shown in FIG. 3B and retain it securely through the use of one or more of grooves, holes, hinges, latches, friction and other mechanical and/or gravitational mechanisms. In another example, the collector coupling 325 may retain the printing fluid collector 345 via magnetic attraction. In one case, an operator of the printing system may be instructed to manually couple the printing fluid collector 345 to the collector coupling 325. The collector coupling 325 may, according to one example, be arranged relative to at least one switch for determining whether the printing fluid collector is coupled to the printing system. In one case, the printing fluid collector 345, when installed as shown in FIG. 36, may replace a corresponding component of the media path 315 such as a platen.

The at least one pressure sensor 340 may comprise at least one differential pressure sensor according to one example. In another example, the at least one pressure sensor may comprise at least one gauge pressure sensor. In a further example, the at least one pressure sensor may comprise at least one vacuum pressure sensor. Other types of pressure sensor may be used according to various examples. The at least one pressure sensor may produce an electrical signal based on the pressure imposed upon it according to various examples.

Figure 4:
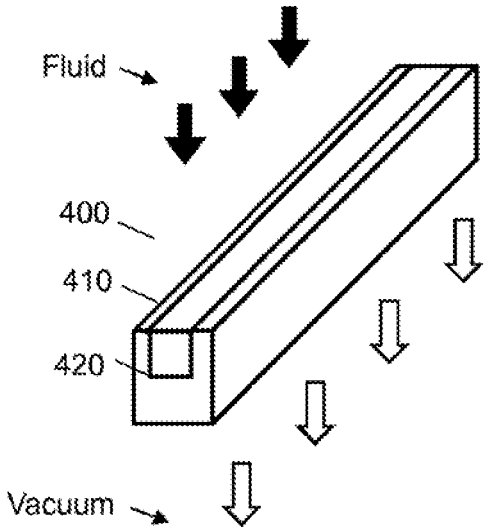
FIG. 4 is a schematic illustration showing a removable printing fluid collector according to an example.

FIG. 4 shows a removable printing fluid collector 400 according to an example. The removable printing fluid collector 400 comprises an elongate collector body 410 and at least one foam filter 420. The elongate collector body 410 is arranged to extend across a width of a media path of a printing system and to receive ejected printing fluid, e.g. printing fluid that is ejected from nozzles of a print head onto a print medium on a media path and that permeates (e.g. passes through at least in part) the print medium. The at least one foam filter 420 is arranged within the elongate collector body 410 for absorption of the received printing fluid. In one case an upper and lower foam filter may be provided, the lower foam filter being located at the bottom of the elongate collector body 410 and the upper foam filter being located within a top opening of the elongate collector body 410. In this case each foam filter may have a different composition to provide for differentiated printing fluid absorption. The at least one foam filter 420, e.g. either or both of the upper and lower filters, may comprise apertures to enable a fluid flow through the printing fluid collector 400. In certain cases at least one foam filter 420 may allow a fluid flow so as to maintain the application of the vacuum generated by the vacuum system 320.

When it is coupled to the printing system 300 via the collector coupling 325, the removable printing fluid collector 400 may, according to one example, be arranged within a set of media transport system components. In one example, the removable printing fluid collector 400 may be arranged between two rollers of the media transport system. In certain examples, the removable printing fluid collector 400 may be arranged within the vacuum system 320 of the printing system, although in the example shown in FIG. 3B it is arranged externally to the vacuum system 320. As the vacuum system 320 is configured to provide a fluid flow through the media path and apply a force to the print medium to retain the print medium on the media path during a print operation, it follows that printing fluid permeating a porous medium may be ejected towards the vacuum system, informing a position of the printing fluid collector. The at least one foam filter 420 may, according to one example, be replaced when saturated with printing fluid. In another example, the at least one foam filter may be reusable after saturation with printing fluid, e.g. by washing and/or compressing said filter.

The examples of FIGS. 1, 2, 3A, 3B and 4 show components of a printing system that enable a porosity or permeability of a print medium to be determined and used to control the printing system with relation to the installation of a suitable printing fluid collector. A number of example methods are described below that may make use of the components of one or more of these examples.

Figure 5:
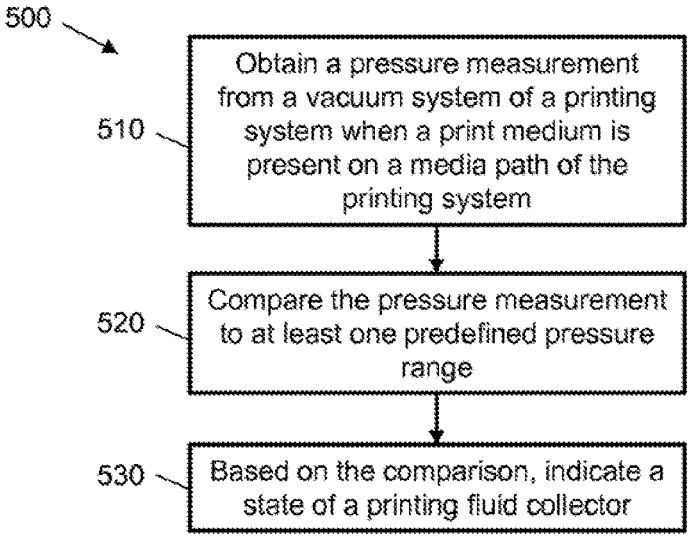
FIG. 5 is a flow diagram showing a method of operating a printing system according to an example.

FIG. 5 shows a method 500 of operating a printing system according to an example. The printing system may comprise one of printing systems 100, 200 and 300 as previously described. At block 510, a pressure measurement is obtained from a vacuum system of the printing system when a print medium is present on a media path of the printing system. At block 520, the pressure measurement obtained at block 510 is compared to at least one predefined pressure range. At block 530, a state of a printing fluid collector is indicated via the printing system, based on the comparison carried out at block 520. This may comprise an operational state of the printing fluid collector, e.g. that a printing fluid collector of a particular type needs to be installed.

In one example, the method 500 may be performed by the porosity determiner 110. In another example, block 510 may be performed by the at least one pressure sensor 340, and blocks 520 and 530 may be performed by the porosity determiner 110. In a further example, block 510 may be performed by the at least one pressure sensor 340, block 520 may be performed by the porosity determiner 110 and block 530 may be performed by the signal generator 120. The indication of a state of a printing fluid collector at block 530 may, according to one example, comprise a notification to a user, via an interface, that the printing fluid collector is not presently coupled to the printing system. In another example, the indication at block 530 may comprise a request for a user to couple the fluid collector to the printing system. In a further example, the indication at block 530 may comprise a request for a user to couple the fluid collector to the printing system if it is determined that the printing fluid collector is not presently coupled to the printing system. According to a still further example, the indication at block 530 may comprise the inhibition of a print operation until it is determined that a suitable printing fluid collector is coupled to the printing system.

Figure 6:
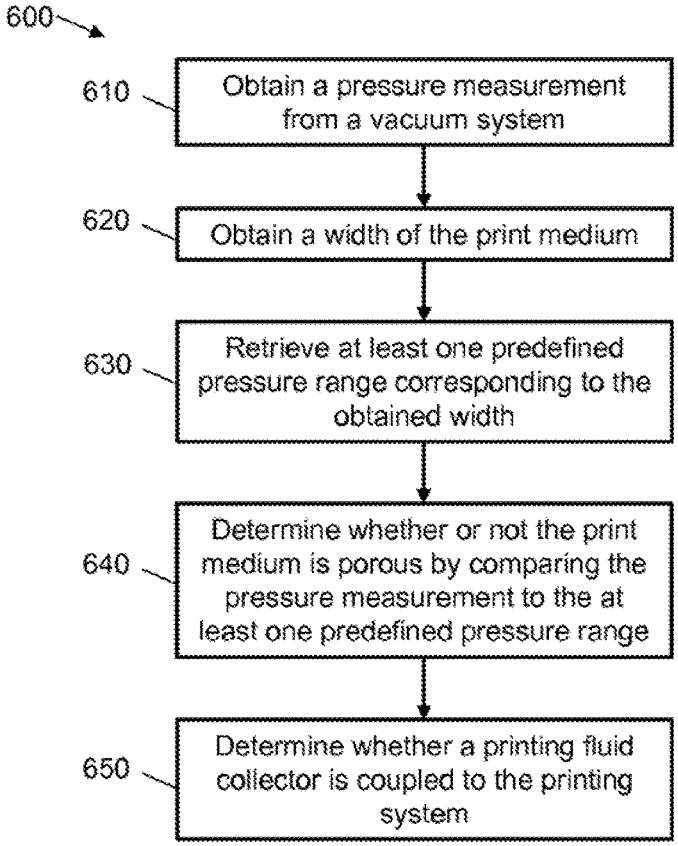
FIG. 6 is a flow diagram showing a method of operating a printing system according to an example.

FIG. 6 shows a method 600 of operating a printing system according to a further example. The method 600 may comprise one possible implementation of the method 500. At block 610, a pressure measurement is obtained from a vacuum system of a printing system when a print medium is present on a media path of the printing system. The printing system may comprise one of printing systems 100, 200 and 300 as previously described. At block 620, a width of the print medium is obtained. At block 630, at least one predefined pressure range, corresponding to the width obtained at block 620, is retrieved. The width of the print medium may determine the portion of the media path covered by the print medium, and consequently the number of exposed holes in the media path which allow fluid flow provided by the vacuum system. Therefore a vacuum generator may be operated to apply a defined pressure for a given width of print medium. At block 640, the pressure measurement obtained at block 610 is compared to the at least one predefined pressure range retrieved at block 630. Porosity data indicative of the print medium not being porous is generated when the pressure measurement is within a first pressure range, and porosity data indicative of the print medium being porous is generated when the pressure measurement is within a second pressure range. For example, a binary parameter indicative of porosity may be set to true if the print medium is determined to be porous. At block 650, a state of a printing fluid collector is indicated. Responsive to the porosity data indicating that the print medium is porous, a determination is made whether the printing fluid collector is coupled to the printing system. At block 650, responsive to the printing fluid collector not being coupled to the printing system a print operation may be prevented and/or a notification may be sent and/or displayed to a user.

In one case, obtaining the width of the print medium at block 620 may comprise generating a request, via an interface, for a user to input the correct width of the print medium. In another case, the obtaining the width of the print medium may comprise a media width detector automatically detecting the width of the print medium. In another case, the width of the print medium may be retrieved from a media definition the for a currently used print medium. The retrieving, at block 630, of the at least one predefined pressure range corresponding to the obtained width may, according to certain examples, comprise retrieving values corresponding to predefined pressure ranges from a lookup table stored within a computer-readable memory.

In at least one example, the at least one predefined pressure range may comprise two predefined pressure ranges. In certain other examples, the at least one predefined pressure range may comprise one predefined pressure range and one additional pressure range that is calculated based the predefined pressure range. The additional pressure range may, according to one example, comprise pressure values that do not fall within the predefined pressure range. In a further example, the additional pressure range may comprise pressure values that are greater than the upper boundary of the predefined pressure range. In a still further example, the additional pressure range may comprise pressure values that are less than the lower boundary of the predefined pressure range. For example, a pressure threshold for a given width of print medium may be retrieved. The obtained pressure measurement may then be compared to the pressure threshold. In one case, if the obtained pressure is less than the pressure threshold, the print medium is indicated as non-porous; if the obtained pressure is greater than the pressure threshold, the print medium is indicated as porous. If the obtained pressure is equal to the pressure threshold one of porous or non-porous may be selected as per a desired implementation.

According to certain examples, a calculation may be performed at block 640 to generate the porosity data from the comparison of the pressure measurement to the at least one predefined pressure range. The porosity data may, according to one example, comprise a numerical value representative of the void fraction of the print medium, which may then be compared to a predefined threshold value to indicate whether the print medium is porous or not porous. In another example, the porosity data may comprise a binary variable whose value may be used to indicate whether the print medium is porous or not porous.

The determining, at block 650, whether the printing fluid collector is coupled to the printing system may, according to certain examples, comprise receiving a signal that indicates whether or not a suitable printing fluid collector is presently installed in the printing system. In one example, the signal may indicate that the printing fluid collector is installed in the printing system. In this case, the printing fluid collector not being installed in the printing system may be determined by said signal not being received. In another example, however, the signal may indicate that the printing fluid collector is not present in the printing system. In this case, the printing fluid collector being present in the printing system may be determined by said signal not being received. In at least one case, the generating of said signal may be caused by at least one switch arranged relative to the collector coupling 325. In a further example, a user may be requested to confirm the presence of the printing fluid collector in the printing system. In this case, the signal that indicates whether or not the printing fluid collector is presently installed in the printing system may be generated by the input of the user.

Figure 7:
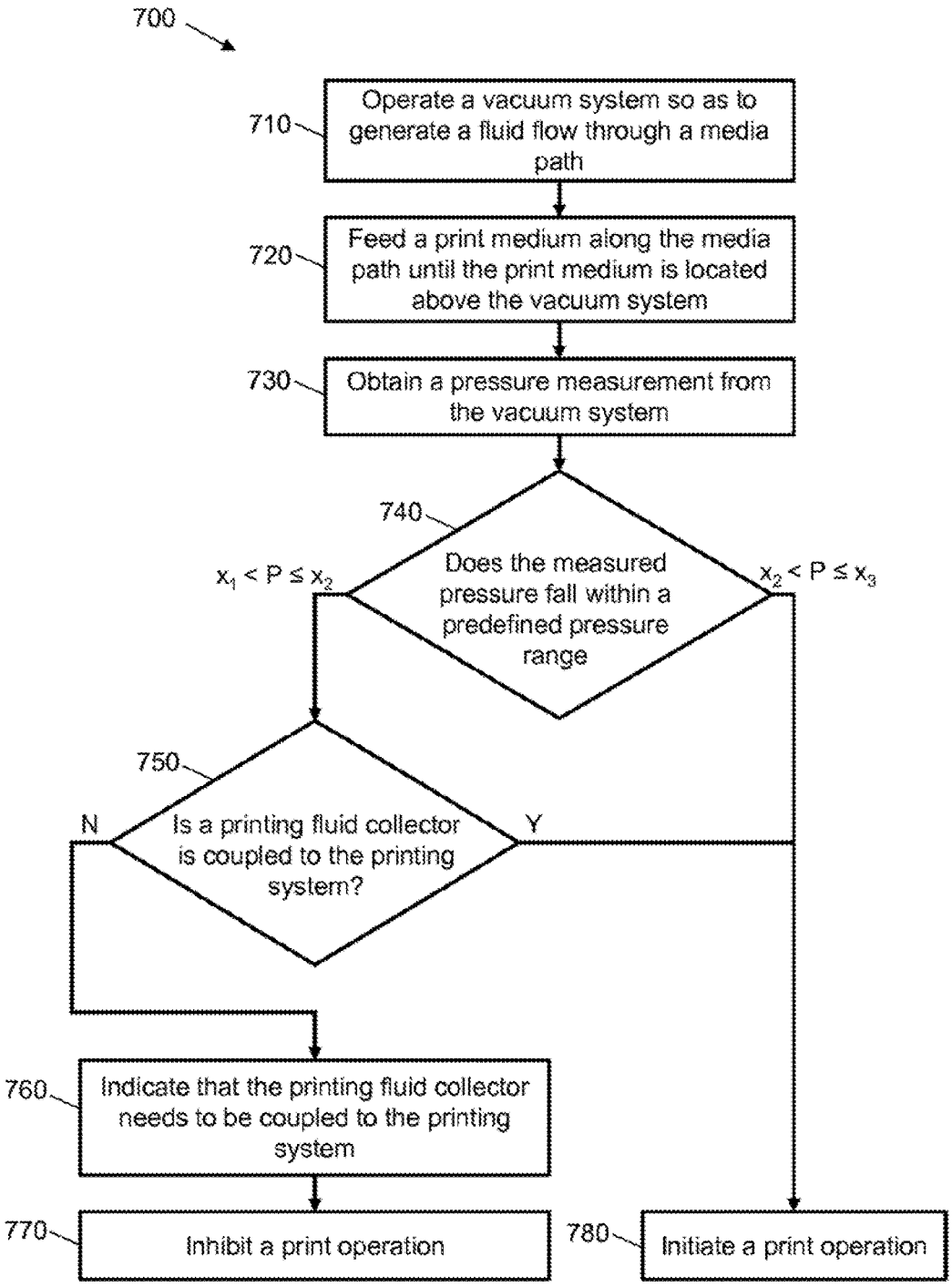
FIG. 7 is a flow diagram showing a method of operating a printing system according to an example.

FIG. 7 shows a method 700 of operating a printing system according to an example. The method 600 may comprise one possible implementation of the method 500. At block 710, a vacuum system of the printing system is operated so as to generate a fluid flow through a media path of the printing system. At block 720, a print medium is fed along the media path until the print medium is located above the vacuum system. At block 730, a pressure measurement is obtained from the vacuum system when the print medium is present on the media path. At block 740, the pressure measurement obtained at block 730 is compared to at least one predefined pressure range. If the pressure measurement, P, is within a first predefined pressure range, $x_1<P\leq x_2$, a signal is obtained, at block 750, indicative of whether a printing fluid collector is coupled to the printing system. In one case, the signal may be generated by at least one switch arranged in relation to the collector coupling 325, e.g. an electro-mechanical switch arranged to alter a voltage signal when activated. Based on a value of the signal obtained at block 750 being indicative of the printing fluid collector not being coupled to the printing system, it is indicated, at block 760, that the printing fluid collector needs to be coupled to the printing, system. At block 770, a print operation on the printing system is inhibited until a value of the signal obtained at block 750 is obtained that indicates that the printing fluid collector is coupled to the printing system. If, at block 740, the pressure measurement P is within a second predefined pressure range, $x_2<P\leq x_3$, a print operation is initiated at block 780. If, at block 750, a value of the obtained signal is indicative of the printing fluid collector being coupled to the printing system, a print operation is initiated at block 780.

The operating of the vacuum system at block 710 may comprise, according to certain examples, driving at least one vacuum generator. The driving of the at least one vacuum generator may reduce the internal pressure of a vacuum chamber. The operating of the vacuum system may further comprise, according to certain examples, suctioning air from a first region relative to the vacuum system to a second region relative to the vacuum system, where the first region may be external to the vacuum system in at least one example. The feeding of the print medium along the media path at block 720 may comprise, in certain examples, a media transport system transporting the print medium. The media transport system may comprise at least one of a platen, rollers, motors and control circuitry.

Figure 8:
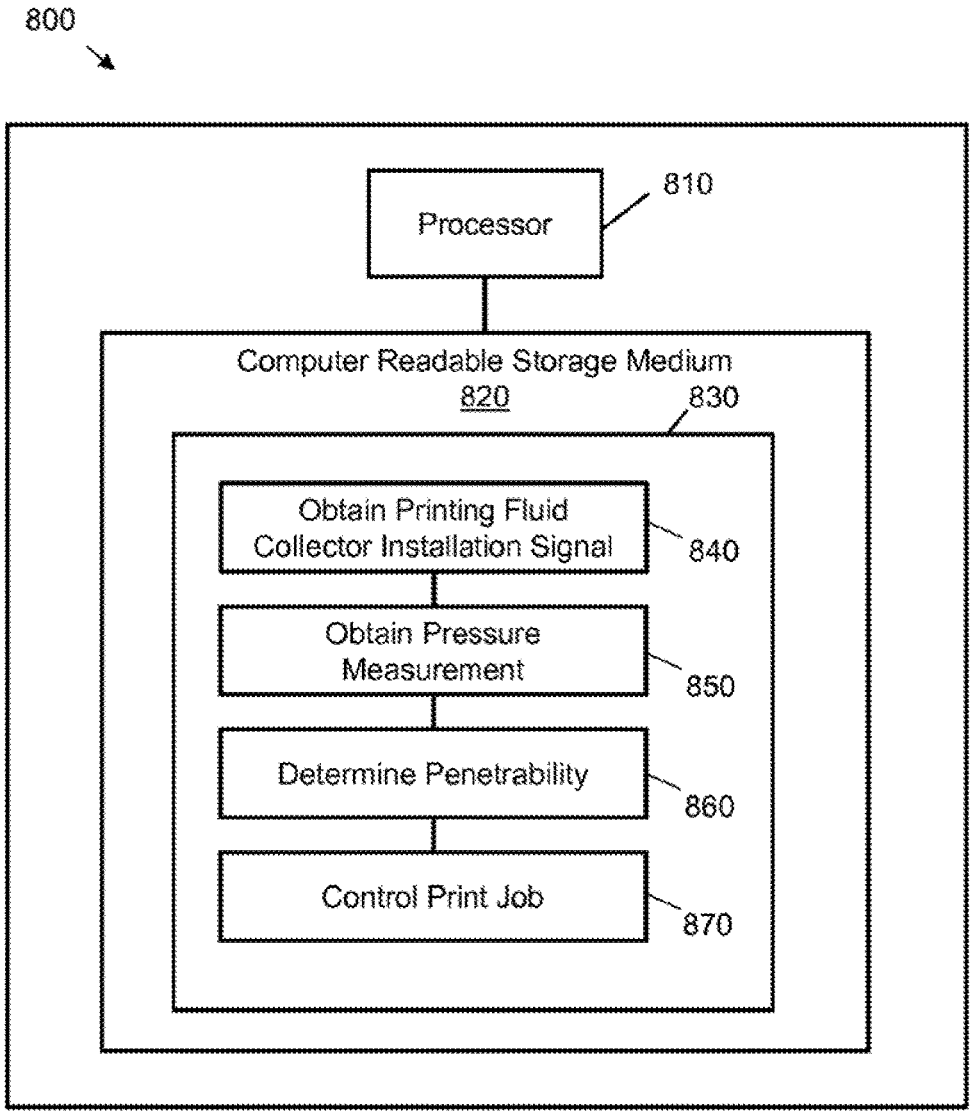
FIG. 8 is a schematic illustration showing a processor and a computer readable storage medium with instructions stored thereon according to an example.

The inhibiting of a print operation at block 770 may, according to various examples, comprise sending at least one signal to at least one of a control system, a media transport and a print head of the printing system, e.g. at least one of the control system 240, the fluid deposit system 210 and the media transport system 220. In one example, inhibiting the print operation may comprise interrupting communications between at least one of the control system, the media transport and the print head of the printing system. Similarly, initiating a print operation at block 780 may, according to various examples, comprise sending at least one signal to at least one of the control system, the media transport and the print head of the printing system. In one example, inhibiting the print operation may comprise reestablishing communications between at least one of the control system, the media transport and the print head of the printing system FIG. 8 shows example components of a printing system 800, which may be arranged to implement certain examples described herein. A processor 810 of the printing system 800 is connectably coupled to a computer-readable storage medium 820 comprising a set of computer-readable instructions 830 stored thereon, which may be executed by the processor 810. Instruction 840 instructs the processor to obtain a signal indicative of whether a printing fluid collector is installed in relation to a media path of the printing system. Instruction 850 instructs the processor to obtain a pressure measurement from a vacuum system of the printing system, the vacuum system being located on the media path of the printing system, the pressure measurement being obtained when a printing substrate is present on the media path. Instruction 860 instructs the processor to determine information indicative of whether a printing fluid in the printing system is able to penetrate the printing substrate, based on the pressure measurement obtained based on instruction 850. Responsive to the information indicating that the printing fluid in the printing system is able to penetrate the printing substrate and a value of the signal indicating that the printing fluid collector is not installed in relation to the media path the processor is instructed to prevent a printing operation upon the printing substrate according to instruction 870.

Processor 810 can include a microprocessor, microcontroller, processor module or subsystem, programmable integrated circuit, programmable gate array, or another control or computing device. The computer-readable storage medium 820 can be implemented as one or multiple computer-readable storage media. The computer-readable storage medium 820 may include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. The computer-readable instructions 830 can be stored on one computer-readable storage medium, or alternatively, can be stored on multiple computer-readable storage media. The computer-readable storage medium 820 or media can be located either in the printing system 800 or located at a remote site from which computer-readable instructions can be downloaded over a network for execution by the processor 810.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printing system comprising:

a media transport system to transport a print medium along a media path of the printing system;

a pressure sensor positioned on the media path to obtain a pressure measurement;

control electronics arranged to determine a porosity of the print medium based in part on the pressure measurement; and a switch to generate a signal relating to a state of a printing fluid collector based on the porosity of the print medium.

2. The printing system according to claim 1, further comprising:

a vacuum system located on the media path of the printing system, wherein the control electronics further determines the porosity of the print medium based on a pressure measurement obtained from the vacuum system when the print medium is present on the media path.

3. The printing system according to claim 2, wherein the vacuum system is configured to apply a force to the print medium to retain the print medium on the media path during a print operation.

4. The printing system according to claim 1, further comprising:

at least one vacuum generator arranged below the media path of the printing system; and a vacuum chamber arranged in fluid communication with the at least one vacuum generator;

wherein the pressure sensor is arranged in the vacuum chamber to provide the pressure measurement, wherein the vacuum system is arranged to provide a fluid flow through the media path, and wherein the pressure sensor is arranged to generate a signal when the print medium is present on the media path, wherein the porosity of the print medium is determined based on the signal.

5. The printing system according to claim 1, further comprising:

a collector coupling arranged to removably couple the printing fluid collector to the printing system, the collector coupling being arranged to mount the printing fluid collector to receive printing fluid during a print operation.

6. The printing system according to claim 1, wherein the control electronics is configured to:

output data indicative of whether the print medium is porous; and wherein the switch is configured to:

obtain the data output by the control electronics;

obtain data indicative of whether the printing fluid collector is installed within the printing system; and responsive to values of the obtained data respectively indicating that the print medium is porous and the printing fluid collector is not installed within the printing system, generate a signal to prevent a printing operation upon the print medium to be initiated.

7. The printing system according to claim 1, further comprising:

a removable printing fluid collector comprising:

an elongate collector body arranged to extend across a width of the media path of the printing system and to receive printing fluid that is ejected above the media path; and at least one foam filter arranged within the elongate collector body for absorption of said printing fluid.

8. A method of operating a printing system, the method comprising:

transporting a print medium along a media path of the printing system;

obtaining a pressure measurement from a vacuum system located on the media path during the transporting;

comparing the pressure measurement to at least one predefined pressure range to determine a porosity of the print medium; and based on the porosity of the print medium, generating a first signal, via the printing system, to indicate a state of a printing fluid collector to collect printing fluid that permeates the print medium.

9. The method according to claim 8, wherein comparing the pressure measurement to the at least one predefined pressure range comprises:

generating data indicative of the print medium being porous when the pressure measurement is within a second pressure range, and wherein indicating the state of the printing fluid collector comprises:

responsive to the data indicating that the print medium is porous, determining whether the printing fluid collector is coupled to the printing system.

10. The method according to claim 8, wherein the printing fluid collector is removable from the printing system.

11. The method according to claim 8, wherein indicating the state of the printing fluid collector comprises:

obtaining a second signal indicative of whether the printing fluid collector is coupled to the printing system; and based on a value of said second signal that is indicative of the printing fluid collector not being coupled to the printing system, indicating in the first signal that the printing fluid collector needs to be coupled to the printing system.

12. The method according to claim 11, further comprising:

inhibiting a print operation on the printing system until a value of said second signal is obtained that indicates that the printing fluid collector is coupled to the printing system.

13. The method according to claim 8, wherein obtaining the pressure measurement comprises:

feeding the print medium along the media path until the print medium is located above the vacuum system.

14. The method according to claim 8, wherein comparing the pressure measurement to the predefined threshold comprises:

generating data indicative of the print medium not being porous when the pressure measurement is within a first pressure range.

15. The method of claim 8, wherein comparing the pressure measurement to the predefined threshold comprises:

obtaining a width of the print medium; and retrieving at least one predefined pressure range corresponding to the obtained width.

16. The method of claim 8, further comprising:

operating the vacuum system so as to generate a fluid flow through the media path of the printing system.

17. A non-transitory computer-readable storage medium comprising a set of computer-readable instructions stored thereon, which, when executed by a processor of a printing system, cause the processor to:

transport a print medium along a media path of the printing system;

obtain a signal indicative of whether a printing fluid collector is installed in relation to the media path of the printing system;

obtain a pressure measurement from a vacuum system of the printing system, the vacuum system being located on the media path of the printing system, the pressure measurement being obtained while the print medium is being transported along the media path;

determine information indicative of whether a printing fluid in the printing system is able to penetrate the print medium based on the pressure measurement; and responsive to the information indicating that the printing fluid in the printing system is able to penetrate the printing substrate and to a value of the signal indicating that the printing fluid collector is not installed in relation to the media path, interrupt a printing operation upon the print medium.

18. The non-transitory computer-readable storage medium of claim 17, wherein the information indicative of whether a printing fluid in the printing system is able to penetrate the print medium is determined by:

obtaining a width of the print medium;

retrieving at least one predefined pressure range corresponding to the obtained width; and determining that the print medium is porous when the pressure measurement is within the predefined pressure range.

19. The non-transitory computer-readable storage medium of claim 17, further comprising:

operating the vacuum system so as to generate a fluid flow through the media path of the printing system.

20. The non-transitory computer-readable storage medium of claim 17, wherein the printing fluid collector is removable from the printing system.

* * * * *